US006670566B1

(12) United States Patent
Wang

(10) Patent No.: US 6,670,566 B1
(45) Date of Patent: Dec. 30, 2003

(54) TACT SWITCH

(75) Inventor: Yung-Hui Wang, Hsin-Tien (TW)

(73) Assignee: Shin Jiuh Corp. (TW)

( * ) Notice: Subject to any disclaimer, the term of this patent is extended or adjusted under 35 U.S.C. 154(b) by 0 days.

(21) Appl. No.: 10/266,595

(22) Filed: Oct. 9, 2002

(51) Int. Cl.[7] ..... H01H 5/18
(52) U.S. Cl. ..... 200/406; 200/512
(58) Field of Search ..... 200/406, 512, 200/513, 520, 521, 276, 276.1, 329, 341

(56) References Cited

U.S. PATENT DOCUMENTS 5,772,010 A * 6/1998 Watanabe et al. ..... 200/406
5,895,901 A * 4/1999 Watanabe et al. ..... 200/534
6,049,047 A * 4/2000 Miyashima et al. ..... 200/284
6,140,596 A 10/2000 Tsay

* cited by examiner

*Primary Examiner*—Lincoln Donovan
*Assistant Examiner*—K. Lee
(74) *Attorney, Agent, or Firm*—Birch, Stewart, Kolasch & Birch, LLP

(57) ABSTRACT

A tact switch has a seat body which has a housing compartment for housing a first conductive electrode and a second conductive electrode, a first elastic element located in the housing compartment above the first and the second conductive electrodes, a press set located in the housing compartment above the first elastic element, and a closure body fastened to the seat body to cover the housing compartment. The press set further includes a hat body which has a coupling section and a second elastic element coupled with the coupling section. The coupling section has an opening and a directing section formed on the periphery of the opening with an inner diameter greater than the coupling section, and a chamfered edge located between the directing section and the coupling section to facilitate insertion and assembly of the second elastic element in the coupling section.

10 Claims, 5 Drawing Sheets

TACT SWITCH

FIELD OF THE INVENTION

The present invention relates to an improved tact switch and particularly a tact switch adopted for use in computers, light pens, mouse devices or remote controllers.

BACKGROUND OF THE INVENTION

Tact switches have been widely used in computers, light pens, mouse devices or remote controllers. A tact switch generally consists of a seat body with an open surface and a reed dome and a pushbutton located in the seat body from a lower portion to an upper portion thereof. There is a closure body mounted onto the seat body to cover all other elements. When the pushbutton receives an external force, the pushbutton presses the metallic reed dome which in turn connects the electrodes located therebelow to output a signal.

Conventional tact switches can be classified in two types. The first type has a rubber pushbutton and a reed dome made of Be—Cu or Pb—Cu. The pliable rubber pushbutton forms a soft contact with the reed dome when in use, thus may has a longer life span. However, the surface of the rubber pushbutton is prone to wear or chip off after being used for a long period of time. And the surface becomes damp and rough. Another type of tact switch has the pushbutton made from plastics. While the plastic pushbutton can maintain a smooth and tidy surface for a long period of time, its bottom end forms a hard contact with the reed dome, thus the life span of the reed dome is shorter.

In view of the aforesaid disadvantages, applicant has developed an improved tact switch which was granted in U.S. Pat. No. 6,140,596, entitled: "Tact Switch". That patent aims to remedy the shortcomings of conventional pushbuttons. It mainly includes a press set formed by coupling a hat body and a second elastic element. The hat body is made from plastics while the second elastic element is made from rubber. The hat body and the second elastic element are matched and coupled tightly, and has a longer durability. However, in order to form a tight coupling to prevent the hat body and the second elastic element from shaking or affecting the downward stroke when depressed, the coupling of the two must be very tight. As they are made from different materials that have different friction, coupling the two becomes difficult and troublesome. Hence although it can resolve some of the problems occurred to the conventional tact switches, there is still room for improvement, especially on the coupling and assembly of the elements.

SUMMARY OF THE INVENTION

Therefore the primary object of the invention is to resolve the aforesaid disadvantages. The invention mainly includes a hat body which has a coupling section and a directing section formed on the periphery of an opening of the hat body with an inner diameter greater than the coupling section. There is a chamfered edge formed at the juncture of the directing section and the coupling section so that a second elastic element may be inserted into the coupling section easily, and the press stroke may be maintained steadily without skew to enable electrodes to deliver signals even deformation occurred to the second elastic element when the pushbutton is depressed.

The foregoing, as well as additional objects, features and advantages of the invention will be more readily apparent from the following detailed description, which proceeds with reference to the accompanying drawings, which are given by way of illustration only, and thus are not limitative of the present invention.

DESCRIPTION OF THE PREFERRED EMBODIMENT

Figure 1:
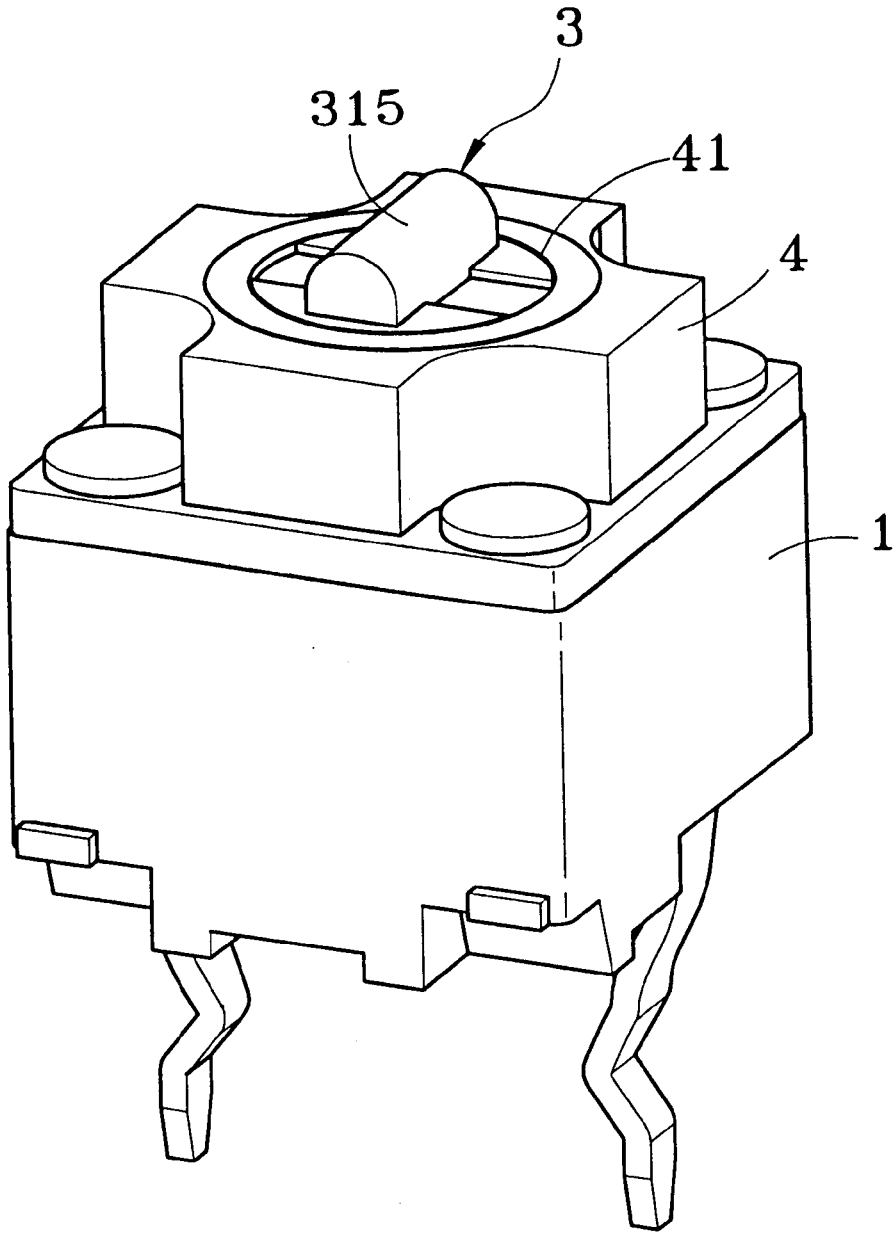
FIG. 1 is a perspective view of the invention.
Figure 2:
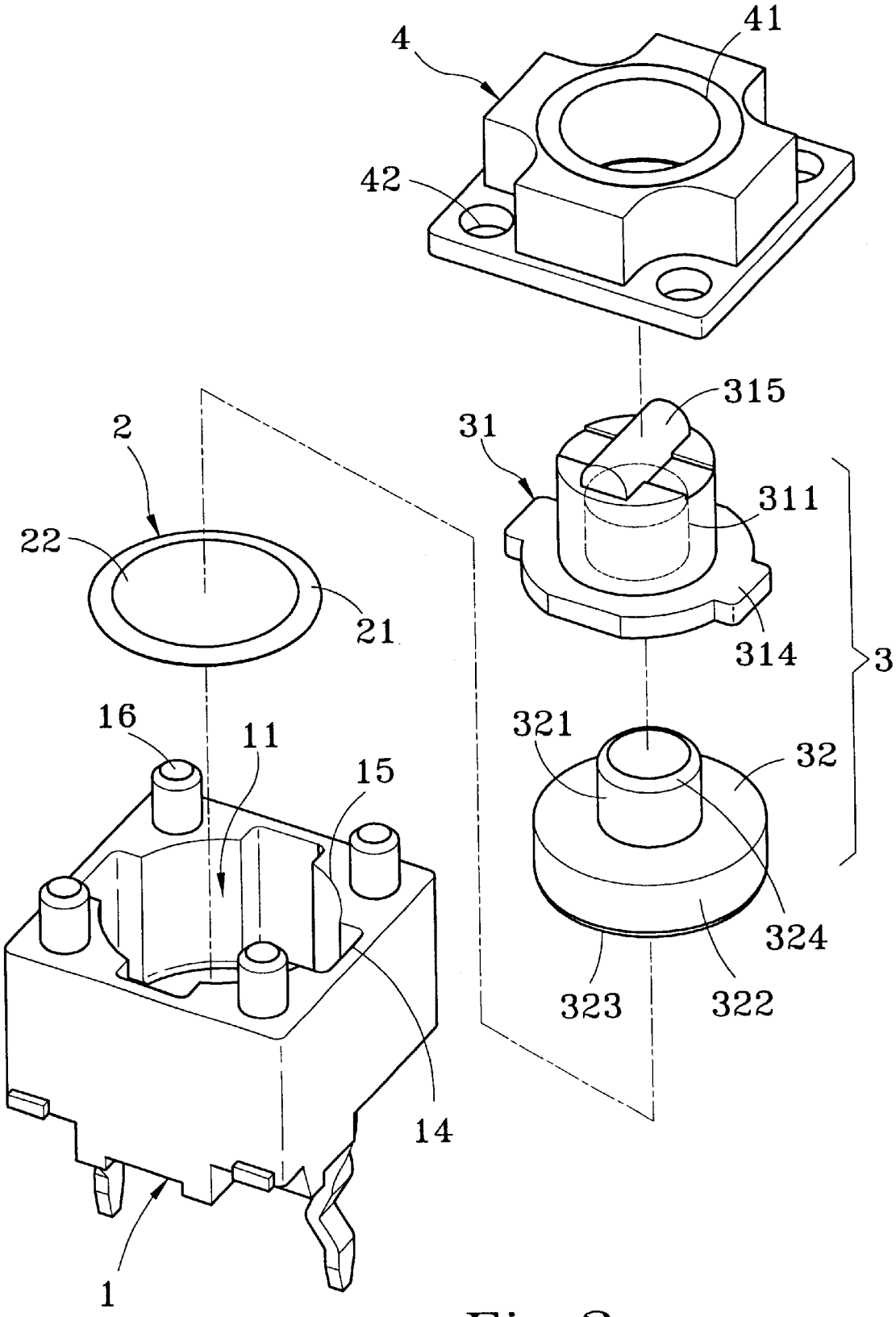
FIGS. 2 and 3 are exploded views of the invention.
Figure 3:
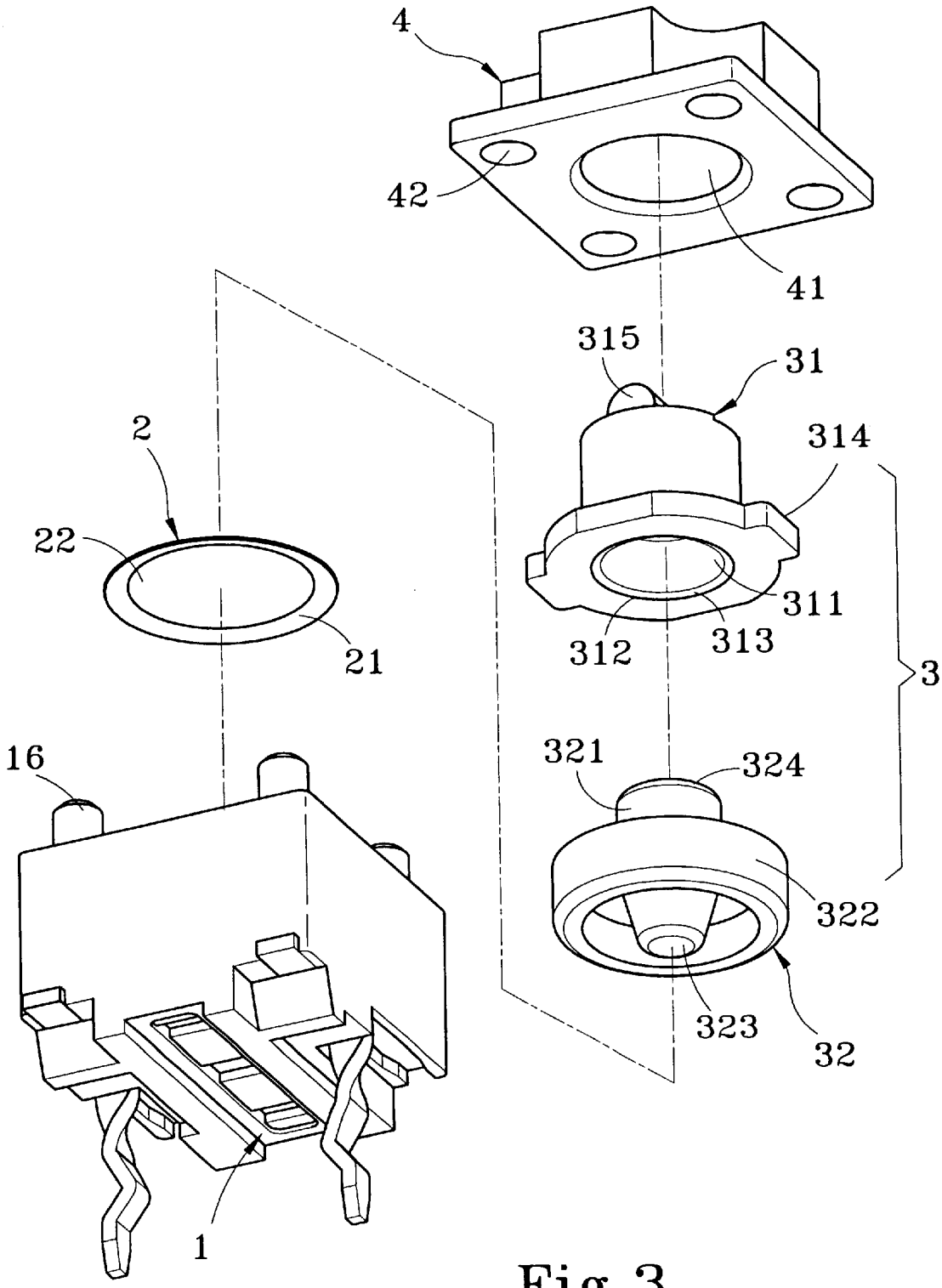

Referring to FIGS. 1, 2, and 3, the tact switch of the invention consists of a seat body 1 which has a housing compartment 11 for accommodating a first conductive electrode 12 and a second conductive electrode 13, a first elastic element 2 located in the housing compartment 11 above the first and the second conductive electrodes 12 and 13, a press set 3 located in the housing compartment 11 above the fist elastic element 2, and a closure body 4 fastened to the seat body 1 to cover the housing compartment 11. The press set 3 further includes a hat body 31 which has a coupling section 311 and a second elastic element 32 coupled with the coupling section 311. The coupling section 311 has an opening. The periphery of the opening forms a directing section 312 with an inner diameter greater than the coupling section 311. The juncture of the directing section 312 and the coupling section 311 forms a chamfered edge 313 to facilitate insertion and assembly of the second elastic element 32 in the coupling section 311.

For assembly, first dispose the first conductive electrode 12 and the second conductive electrode 13 in the housing compartment 11 of the seat body 1. Then place the first elastic element 2 in the housing compartment 11. The first elastic element 2 is made from an elastic blade with a dome top and has a flat peripheral rim 21 to press constantly the second conductive electrode 13 and a center bulged portion 22 spaced from the first conductive electrode 12 at a selected gap. Hence no conduction occurs when the first elastic element 2 is initially mounted. Next, couple the second elastic element 32 with the hat body 31. The second elastic element 32 is integrally formed and includes a connecting section 321 to engage with the coupling section 311, a balance section 322 to be contained in the housing compartment 11, and a compression section 323 to press the first elastic element 1. The connecting section 321 has a top end formed a tapered edge 324 with a smaller diameter than the connecting section 321. Thus when the second elastic element 32 is disposed in the coupling section 311, the tapered edge 324 of the connection section 321 may be coupled with the chamfered edge 313 to make insertion of the connecting section 321 of the second elastic element 32 into the coupling section 311 of the hat body 31 smoothly and snugly even though the second elastic element 32 is made from a pliable material such as rubber or plastics. Then the assembled second elastic element 32 and the hat body 31 is placed into the housing compartment 11 of the seat body 1. The housing compartment 11 of the seat body 1 and the hat body 31 have respectively retaining slots 14 and anchor lugs 314 formed on opposing sides thereof to couple with each other to facilitate positioning. The housing compartment 11 further has side walls formed a coupling surface 15 to allow the assembly of the second elastic element 32 and the hat body 31 to slip into and position accurately without skewing. The seat body 1 also has anchor struts 16 located on the periphery to engage with retaining holes 42 formed on the closure body 4 corresponding to the anchor struts 16 to enable the closure body 4 to couple and cover the seat body 1. The hat body 31 has a press head 315 on the top end which runs through an opening 41 formed on the closure body 4 and exposes outside the closure body 4 to receive external forces.

Figure 4A:
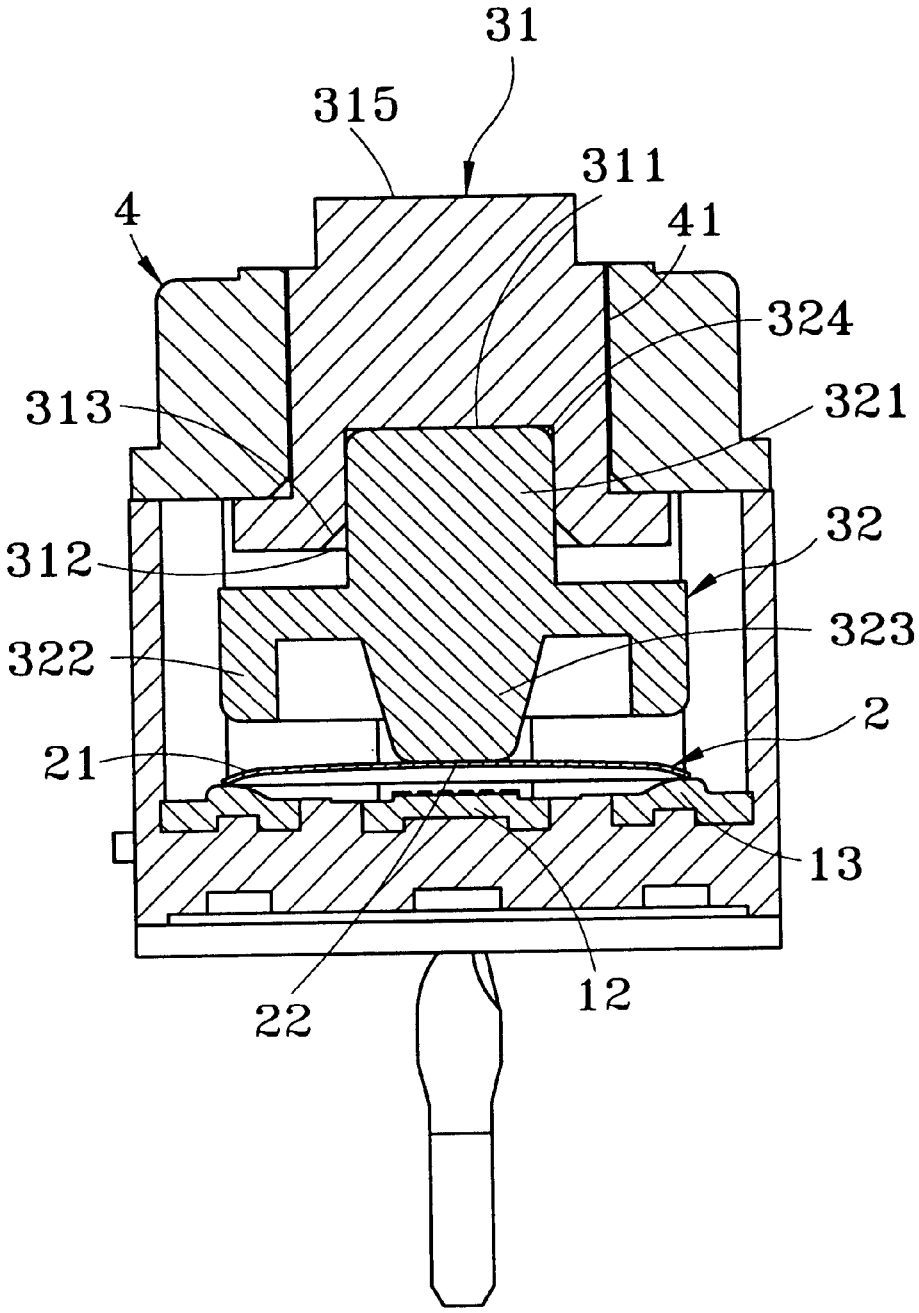
FIGS. 4A and 4B are sectional views of the invention in operating conditions.
Figure 4B:
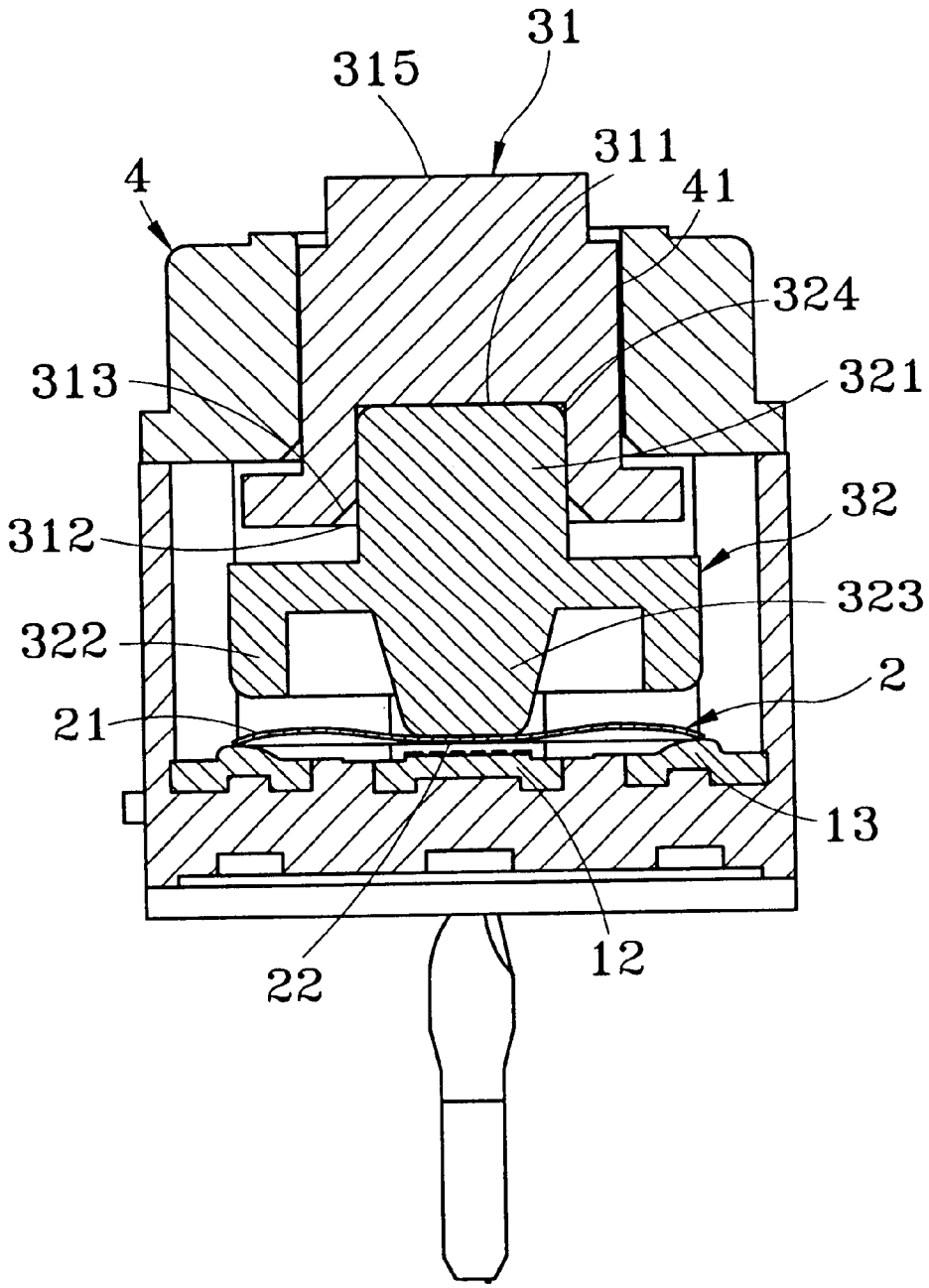

Referring to FIGS. 4A and 4B, when the tact switch of the invention is in use, an external force is exerted on the press head 315. The outer diameter of the press head 315 coincides with the inner diameter of the closure body 4 so that the tact switch may be moved downwards in a balanced manner for the first stage. As the hat body 31 is coupled closely with the second elastic element 32, when the hat body 31 is moved downwards under the external force, the second elastic element 32 is also moved downwards. The retaining slots 14 of the seat body 1 and the anchor lugs 314 of the hat body 31 enable the tact switch to generate a second stage downward movement in a balanced manner. The coupling surface 15 on the side wall of the housing compartment 11 may couple with the balance section 322 of the second elastic element 32 so that the second elastic element 32 may be moved linearly downwards to compress the first elastic element 2. As a result, the center bulged portion 22 of the first elastic element 2 receives the force in a balanced manner and makes the first conductive electrode 12 and the second conductive electrode 13 to form a conductive connection. As the second elastic element 32 is made from rubber or plastics, a deformation occurs when it is subject to compression. The housing compartment 11 has a hollow recess corresponding to the balance section 322 and the compression head 323 that presses the first elastic element 2 to absorb the deformation occurred. In the event that the external force exceeds the desired compression stroke, deformation occurs to the entire second elastic element 32. However due to the connecting section 321 has a selected height which is not fully housed in the coupling section 311 of the hat body 31, the connecting section 321 has a lower portion exposed outside the coupling section 311 to absorb the deformation mentioned above. In addition, as the connecting section 321 of the second elastic element 32 is coupled tightly with the hat body 31, no skew will happen when they are being depressed downwards. Thus the invention can simultaneously resolve the problems of difficult assembly, unsteady downward compression and excessive deformation that happen to the conventional tact switches.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A tact switch, comprising:

a seat body having a housing compartment for accommodating a first conductive electrode and a second conductive electrode;

a first elastic element located in the housing compartment above the first and the second conductive electrodes;

a press set located in the housing compartment above the first elastic element; and a closure body fastened to the seat body to cover the housing compartment;

wherein the press set further includes a press head exposed outside the closure body and a hat body which has a coupling section and a second elastic element coupled with the coupling section;

wherein the coupling section has an opening and a directing section formed on the periphery of the opening with a diameter greater than the coupling section, and a chamfered edge located between the directing section and the coupling section to facilitate insertion and assembly of the second elastic element in the coupling section;

wherein the second elastic element has a connecting section to engage with the coupling section, a top end of the connecting section is formed with a tapered edge which has an outer diameter smaller than the diameter of the coupling section.

2. The tact switch of claim 1, wherein the housing compartment of the seat body and the hat body have respectively retaining slots and anchor lugs to facilitate positioning, the anchor lugs being formed on opposing sides of the hat body.

3. The tact switch of claim 1, wherein the second elastic element is integrally formed, a balance section located in the housing compartment and a compression head for pressing the first element.

4. The tact switch of claim 3, wherein the housing compartment has inner walls formed with a coupling surface to couple with the balance section to facilitate downward movements of the second elastic element.

5. The tact switch of claim 2, wherein the anchor lugs are engagable with a bottom side of the closure body.

6. The tact switch of claim 5, wherein the anchor lugs are located only at a lower end of the hat body.

7. The tact switch of claim 6, wherein the anchor lugs are located on a brim of the lower end of the hat body and wherein sidewalls of the hat body extend upwardly from the brim and have a uniform, uninterrupted circumference.

8. The tact switch of claim 7, wherein the housing compartment has inner walls formed with a coupling surface to couple with the balance section to facilitate downward movements of the second elastic element.

9. The tact switch of claim 5, wherein the closure body has an opening for receiving the hat body and wherein the opening of the closure body has a generally uniform, uninterrupted circumference.

10. The tact switch of claim 2, wherein the closure body has an opening for receiving the hat body and wherein the opening of the closure body has a generally uniform, uninterrupted circumference.

* * * * *